US006935517B1

(12) United States Patent
Reed et al.

(10) Patent No.: US 6,935,517 B1
(45) Date of Patent: Aug. 30, 2005

(54) SNOWBOARD SUPPORT AND DISPLAY RACK

(76) Inventors: Robert Reed, 6797 Mesada St., Alta Loma, CA (US) 91701; Brent Reed, 6797 Mesada St., Alta Loma, CA (US) 91701

( * ) Notice: Subject to any disclaimer, the term of this patent is extended or adjusted under 35 U.S.C. 154(b) by 0 days.

(21) Appl. No.: 10/457,740

(22) Filed: Jun. 9, 2003

(51) Int. Cl.[7] ..... A47F 7/00
(52) U.S. Cl. ..... 211/85.7; 211/70.5
(58) Field of Search ..... 211/85.7, 70.5, 211/175, 106.01, 87.01; D6/552, 553; 248/201, 248/301, 304, 235

(56) References Cited

U.S. PATENT DOCUMENTS

| | | | | | |
|---|---|---|---|---|---|
| 2,767,854 | A | * | 10/1956 | Barrett | 211/85.7 |
| 4,419,872 | A | * | 12/1983 | Plifka | 211/70.5 |
| D313,522 | S | * | 1/1991 | Bingham | D6/547 |
| 4,988,007 | A | * | 1/1991 | Chiarot | 211/70.5 |
| 5,078,279 | A | * | 1/1992 | Hancock et al. | 211/64 |
| 5,477,968 | A | | 12/1995 | Largent et al. | 211/60.1 |
| 5,601,196 | A | * | 2/1997 | Heer et al. | 211/65 |
| D384,576 | S | * | 10/1997 | Holder | D8/373 |
| D386,030 | S | | 11/1997 | York | D6/552 |
| 5,799,915 | A | | 9/1998 | Morey | 248/201 |
| 5,826,908 | A | * | 10/1998 | McBride | 211/70.5 |
| 5,957,819 | A | * | 9/1999 | Cortesi | 482/121 |
| 6,196,397 | B1 | | 3/2001 | Maher | 211/85.7 |
| 6,712,226 | B1 | * | 3/2004 | Williams, Jr. | 211/85.7 |

* cited by examiner

*Primary Examiner*—Jennifer E. Novosad
(74) *Attorney, Agent, or Firm*—Goldstein Law Offices P.C.

(57) ABSTRACT

A snowboard support and display rack, for selectively supporting and displaying a snowboard upon a vertical support structure. The rack comprises a left engagement member and a right engagement member, each comprising a front prong, a rear prong, a junction located therebetween, and a base member contiguous with and extending perpendicularly inward from the rear prong. After attachment to the support structure of the left and right engagement members at the same height, the prongs each extend vertically upward. Each engagement member has a vertical slot defined by the prongs and the junction located therebetween, into which the snowboard is selectively lowered for support and display of the snowboard. The engagement members are separately selectively mounted to the vertical support structure by attaching the rear surface of the base member to the support structure. In a second embodiment of the rack, the two engagement members are attached to one another by a centrally located substantially rectangular base member.

5 Claims, 4 Drawing Sheets

SNOWBOARD SUPPORT AND DISPLAY RACK

BACKGROUND OF THE INVENTION

1. Field of the Invention

The invention generally relates to a rack, and in particular relates to a snowboard support and display rack.

2. Description of the Related Art

Snowboarding is a popular sport in which a rider glides downhill on snow covered surfaces riding a device known as a snowboard. Snowboards are often painted with various colors and designs, and some of the more elaborate snowboards might even be considered to be works of art. However, snowboards are unwieldy off the slopes and are not readily displayed. Accordingly, there is a need for a snowboard support and display rack, for storage of a snowboard and also for displaying the snowboard in an aesthetically pleasing manner.

A variety of rack assemblies are available for storage and display of sports equipment. For example, U.S. Pat. No. 5,477,968 to Largent appears to show a rack having side and cross bars for supporting and displaying sports equipment. However, Largent provides a rack supportable upon a horizontal platform such as a floor and is not suited for mounting on a vertical support structure such as a wall.

Additionally, U.S. Pat. No. 5,799,915 to Morey appears to show a rack for supporting a snowboard. However, Morey appears to contemplate attachment of the snowboard to the rack by engaging the rack with a plurality of rotatable members. Accordingly, Morey does not provide a rack which allows one-step removal and insertion of the snowboard.

Moreover, U.S. Pat. No. 6,196,397 to Maher appears to show a rack designed to support a gliding board. However, the engagement members of Maher are configured to support the heel edge and the toe edge of the gliding board in a vertical orientation. Consequently, Maher is not well suited for supporting the snowboard in a horizontal orientation.

Furthermore, U.S. Pat. No. D386,030 to York appears to show an ornamental design for a rack for a snowboard. However, York appears to show a rack comprising a substantially rectangular enclosure, and does not provide a rack into which a snowboard may be easily inserted and from which the snowboard may be easily removed.

While these devices may be suitable for the particular purpose employed, or for general use, they would not be as suitable for the purposes of the present invention as disclosed hereafter.

SUMMARY OF THE INVENTION

It is an object of the invention to provide a rack which is capable of supporting a snowboard in a horizontal orientation. Accordingly the rack has two vertical slots for insertion therein of the snowboard, and is well suited for supporting the snowboard in a horizontal orientation.

It is another object of the invention to provide a rack into which a snowboard may be easily inserted and from which the snowboard may be easily removed. Accordingly, to support the snowboard upon the rack, the snowboard is simply vertically lowered into the slots of the rack, and to remove the snowboard from the rack, the snowboard is simply vertically raised out from the slots of the rack.

It is yet another object of the invention to produce a rack which is well suited for retail establishments that sell snowboards. Accordingly, the snowboard is only mimimally obscured by the rack while being supported upon the rack, and consequently, a customer is able to see virtually the entire snowboard, even while it is being supported upon the rack.

It is an additional object of the invention to produce a rack for a snowboard which will not scratch or otherwise damage the snowboard upon selective insertion of the snowboard into the rack. Accordingly, the slots of the rack are lined with resilient protective inserts which prevent the snowboard from becoming scratched or otherwise damaged upon selective insertion of the snowboard into the rack.

It is a further object of the invention to produce a rack for a snowboard which is not unduly expensive. Accordingly, the rack may be constructed from plastic materials and its cost is not prohibitive.

The invention is a snowboard support and display rack, for selectively supporting and displaying a snowboard upon a vertical support structure. The rack comprises a left engagement member and a right engagement member, each comprising a front prong, a rear prong, a junction located therebetween, and a base member contiguous with and extending perpendicularly inward from the rear prong. After attachment to the support structure of the left and right engagement members at the same height, the prongs each extend vertically upward. Each engagement member has a vertical slot defined by the prongs and the junction located therebetween, into which the snowboard is selectively lowered for support and display of the snowboard. The engagement members are separately selectively mounted to the vertical support structure by attaching the rear surface of the base member to the support structure. In a second embodiment of the rack, the two engagement members are attached to one another by a centrally located substantially rectangular base member.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

There are three embodiments of the snowboard support and display rack 10, namely, a first embodiment, a second embodiment, and a third embodiment. The first embodiment will be described with reference to FIGS. 3–6. The second embodiment will be described with reference to FIGS. 1–2. The third embodiment will be described with reference to FIG. 7. Each of these embodiments will be described in turn.

Figure 5:
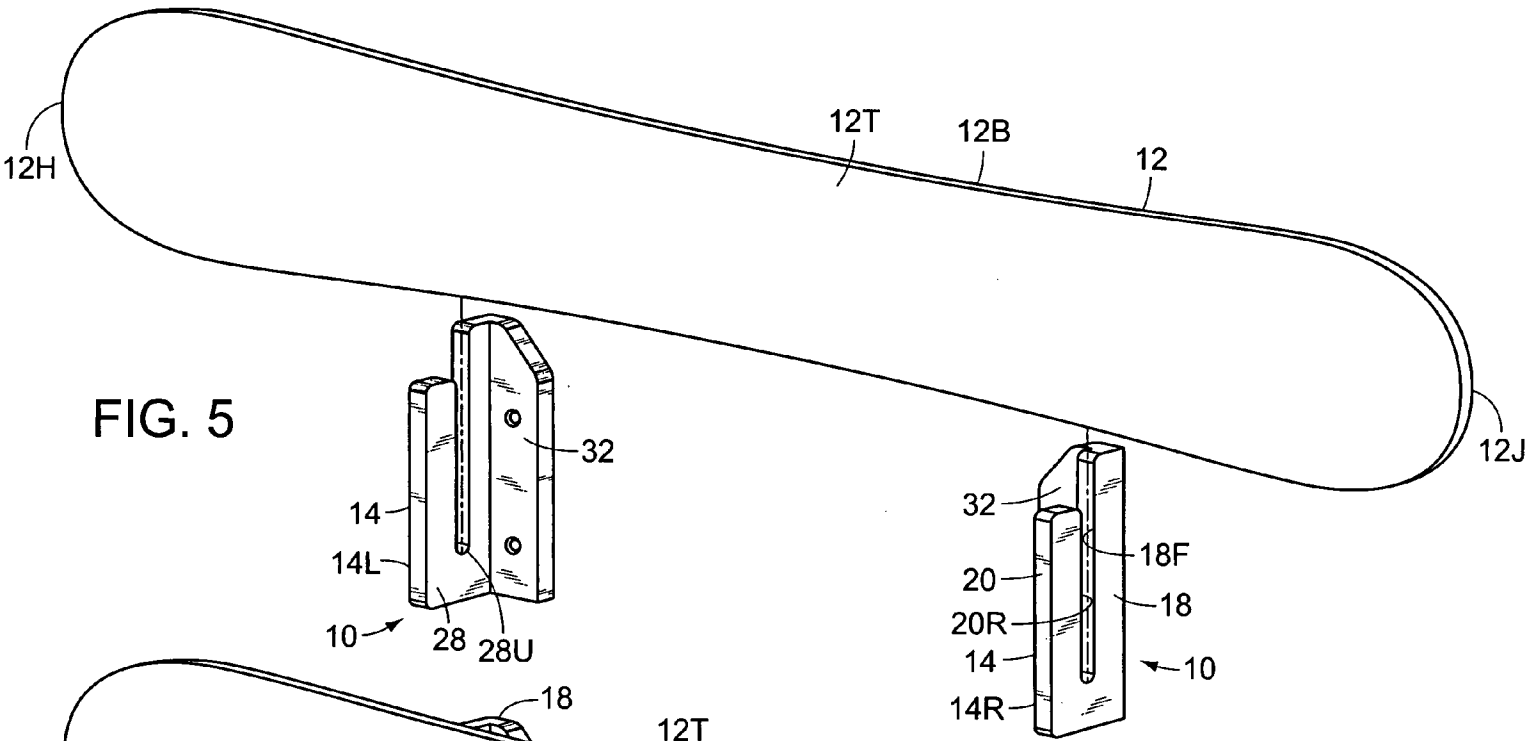
FIG. 5 is a perspective view of the first embodiment of the snowboard support and display rack, wherein hatched lines indicate the direction in which a snowboard is lowered in order to be supported by the rack.

FIG. 5 illustrates the first embodiment of the snowboard support and display rack 10, wherein a snowboard 12 is positioned for selective insertion therein. The first embodiment of the snowboard support and display rack 10 comprises a pair of engagement members 14, and in particular, a left engagement member 14L and a right engagement member 14R. The engagement members 14L, 14R are mounted upon a support structure such as a wall, at equal height, for engaging and supporting the snowboard 12 in a substantially horizontal orientation at a position which is elevated with respect to the ground. In FIG. 5, the substantially flat, elongated snowboard 12, having a top surface 12T, a bottom surface 12B, a toe 12J, and a heel 12H, is positioned for selective insertion into the two engagement members 14L, 14R of the rack 10.

Figure 3:
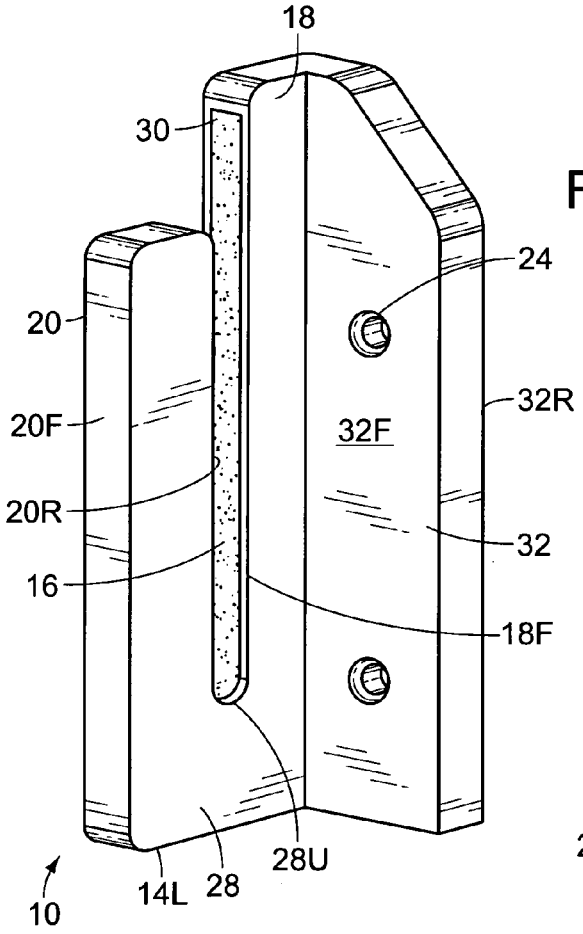
FIG. 3 is a perspective view of a left engagement member of a first embodiment of the snowboard support and display rack.

Turning momentarily to FIG. 3, the left engagement member 14L is shown. The left engagement member 14L and the right engagement member 14R have substantially the same structure, except that they differ in that the left engagement member 14L is a mirror image of the right engagement member 14R. Accordingly, a description of the structure of the left engagement member 14L will suffice as a description of the right engagement member. The left engagement member 14L comprises a front prong 20, a rear prong 18, a junction 28 which connects the front prong 20 to the rear prong 18, and a base member 32. The junction 28 has a curved upper surface 28U upon which the snowboard 12 is substantially supported when the rack 10 is being deployed for support of the snowboard 12. The base member 32 is contiguous with the rear prong 18, extends from the rear prong 18 at a right angle, and is used for anchoring the left engagement member 14L to the wall. The front prong 20 and the rear prong 18 extend vertically upward from the junction 28, after the engagement members 14L, 14R have been selectively attached to the support structure. The front prong 20 has a front surface 20F and a rear surface 20R. The rear prong 18 has a front surface 18F. The engagement members 14 each have a vertically oriented slot 16 defined by the rear surface 20R of the front prong 20, the upper surface 28U of the junction 28, and the front surface 18F of the rear prong 18. The snowboard is selectively inserted into the slots 16 of the engagement members 14L, 14R during deployment of the rack 10. The rear surface 20R of the front prong 20, and the front surface 18F of the rear prong 18, are substantially lined with a protective insert 30, comprising a strip of resilient material which protects the snowboard 12 from becoming scratched or otherwise damaged when selectively inserted into or removed from the rack 10. The front prong 20 extends upwards for a smaller distance than does the rear prong 18, in order to facilitate the snowboard's 12 insertion into and removal from the engagement members 14L, 14R. The base member 32 has a front surface 32F, a rear surface 32R, and two circular openings 24 extending fully from the front surface 32F to the rear surface 32R. The engagement members 14L and 14R are attached to the support structure by selectively inserting a screw into the circular openings 24, and by subsequently threading the screw into the support structure.

Figure 4:
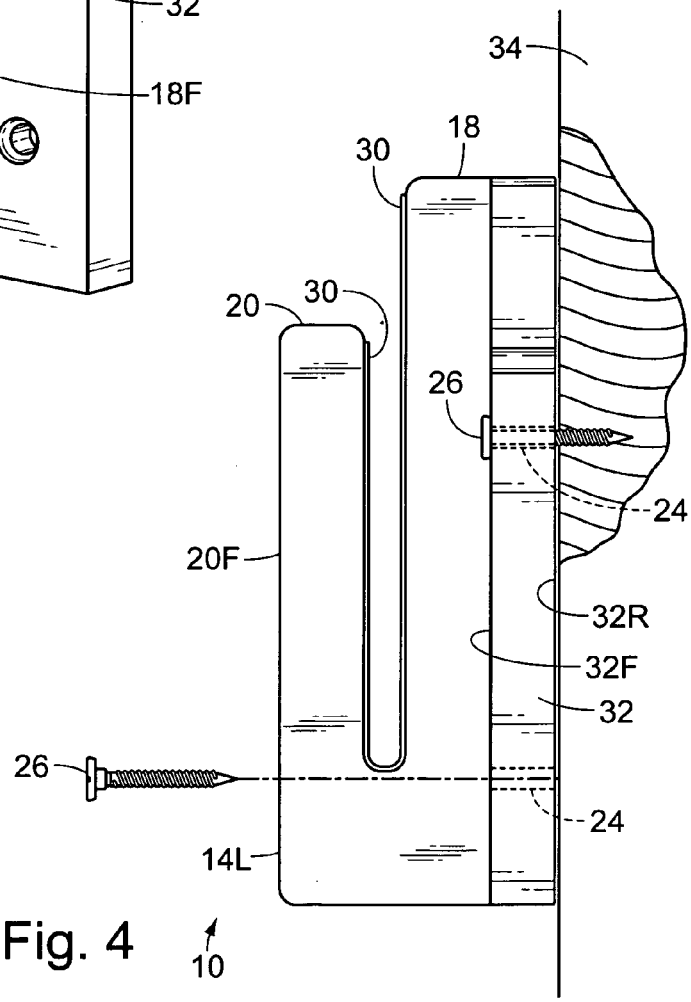
FIG. 4 is a side view of the left engagement member of the first embodiment of the snowboard support and display rack positioned for attachment to a wall, wherein a screw is positioned for selectively attaching the engagement member to the wall, and wherein portions of the wall have been broken away to show another screw extending into the wall.

FIG. 4 illustrates a side view of the left engagement member 14L, wherein the rear surface 32R of the base member 32 is positioned flush against the support structure 34, and wherein one of the screws 26 is positioned for selectively insertion into the circular opening 24 in order to attach the engagement member 14L to the support structure 34. Portions of the support structure 34 have been broken away to illustrate the screw 26 extending partially into the support structure 34, in order to firmly attach the engagement member 14 to the support structure 34.

Figure 6:
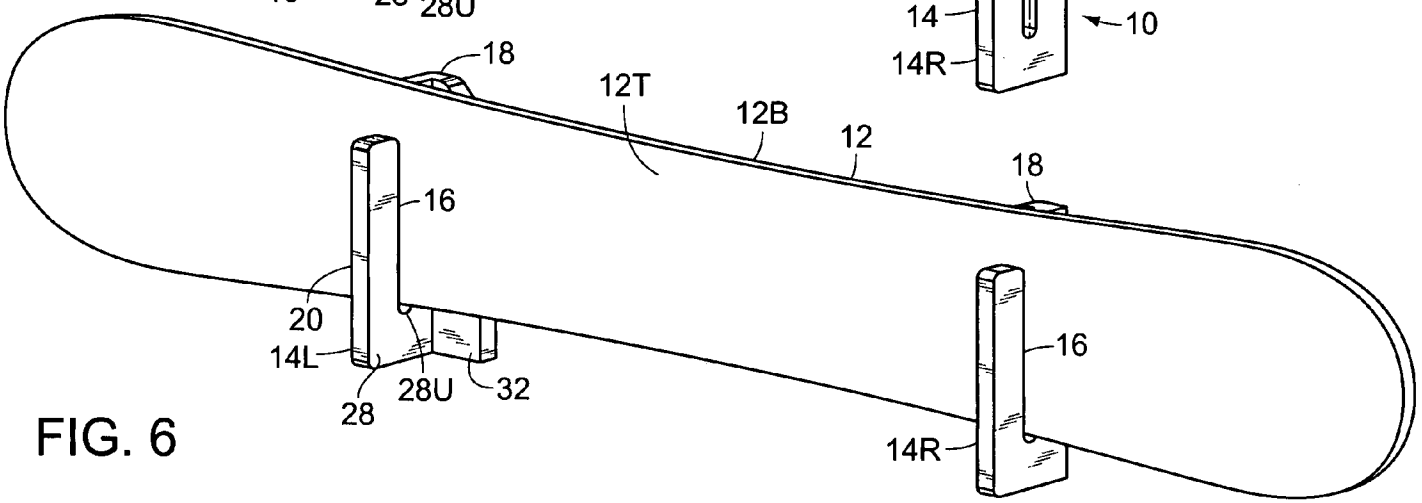
FIG. 6 is a perspective view of the first embodiment of the snowboard support and display rack, wherein the snowboard is supported by the rack.

FIG. 6 illustrates the first embodiment of the snowboard support and display rack 10, wherein the snowboard 12 is being supported upon the rack 10 in a substantially horizontal orientation. The top surface 12T of the snowboard 12 is substantially visible. The top surface 12T and the bottom surface 12B of the snowboard 12 are bracketed by the slots 16 of the left engagement member 14L and the right engagement member 14R. The weight of the snowboard 12 rests substantially upon the upper surfaces 28U of the junctions 28 between the front prongs 20 and the rear prongs 18.

Figure 1:
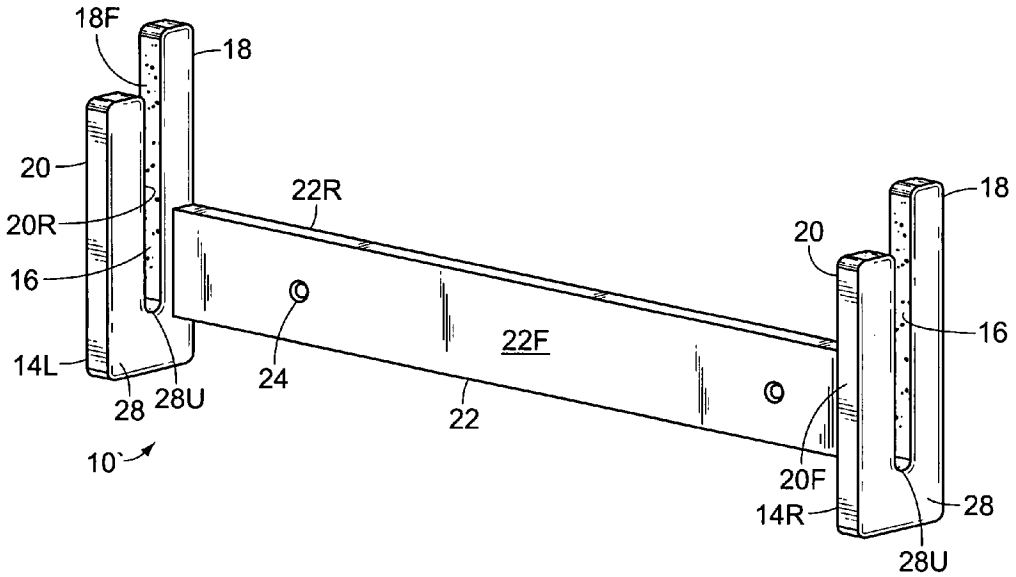
FIG. 1 is a perspective view of a second embodiment of a snowboard support and display rack.

FIG. 1 illustrates the second embodiment of the snowboard support and display rack 10', comprising a left engagement member 14L, a right engagement member 14R, and a substantially rectangular base member 22 extending fully therebetween. The second embodiment of the rack 10' primarily differs from the first embodiment in that the left engagement member 14L is connected to the right engagement member 14R by the elongated base member 22. The left engagement member 14L and the right engagement member 14R have a substantially identical structure. Consequently, a description of the structure of the left engagement member 14L will suffice as a description of the right engagement member 14R. The left engagement member 14L has a rear prong 18, a front prong 20, and a junction 28 from which said prongs 18, 20 extend vertically upward. The front prong 20 has a rear surface 20R. The rear prong 18 has a front surface 18F. The junction 28 has an upper surface 28U upon which the snowboard 12 is substantially supported when the rack 10' is being deployed. The left engagement member 14L has a vertical slot 16 defined by the rear surface 20R of the front prong 20, the upper surface 28U of the junction 28, and the front surface 18F of the rear prong 18. The rear prong 18 extends upward from the junction 28 for a distance which is greater than the distance which the front prong 20 extends vertically upward, in order to facilitate easy insertion of the snowboard 12 into the rack 10', and easy removal of the snowboard 12 from the rack 10'. The base member 22 has a front surface 22F, a rear surface 22R, and two circular openings 24 extending fully from the front surface 22FR to the rear surface 22R. The second embodiment of the rack 10' is anchored to a support structure by inserting a threaded screw into each of the circular openings 24 and threading said screws into the support structure.

Figure 2:
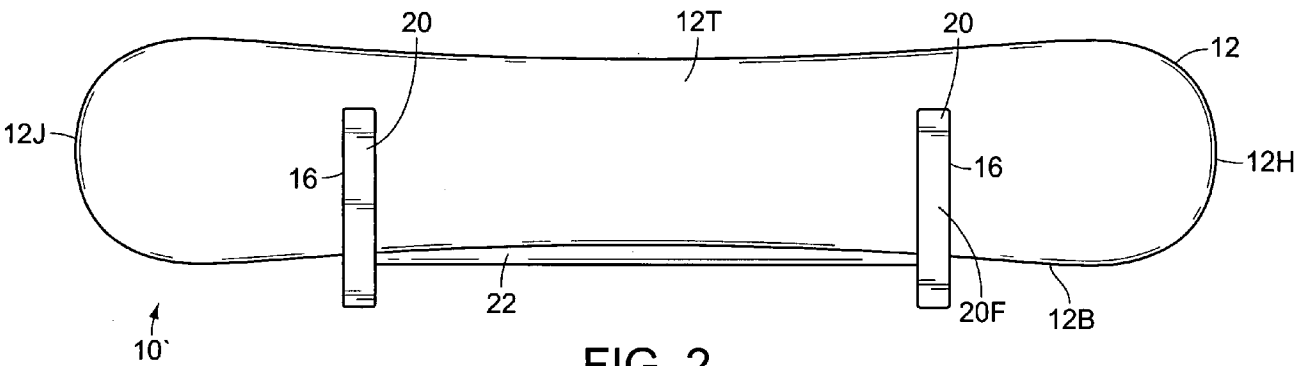
FIG. 2 is a front elevational view of the second embodiment of the snowboard support and display rack, wherein a snowboard is being selectively supported upon the rack.

FIG. 2 illustrates the second embodiment of a snowboard support and display rack 10', wherein a snowboard 12 is being selectively supported by the rack 10'. The top surface 12T of the snowboard 12 is visible. The snowboard 12 is bracketed by the slots 16 within each of the engagement members 14L and 14R. The screws, obscured by the snowboard 12, have anchored the base member 22 to the support structure.

Figure 7:
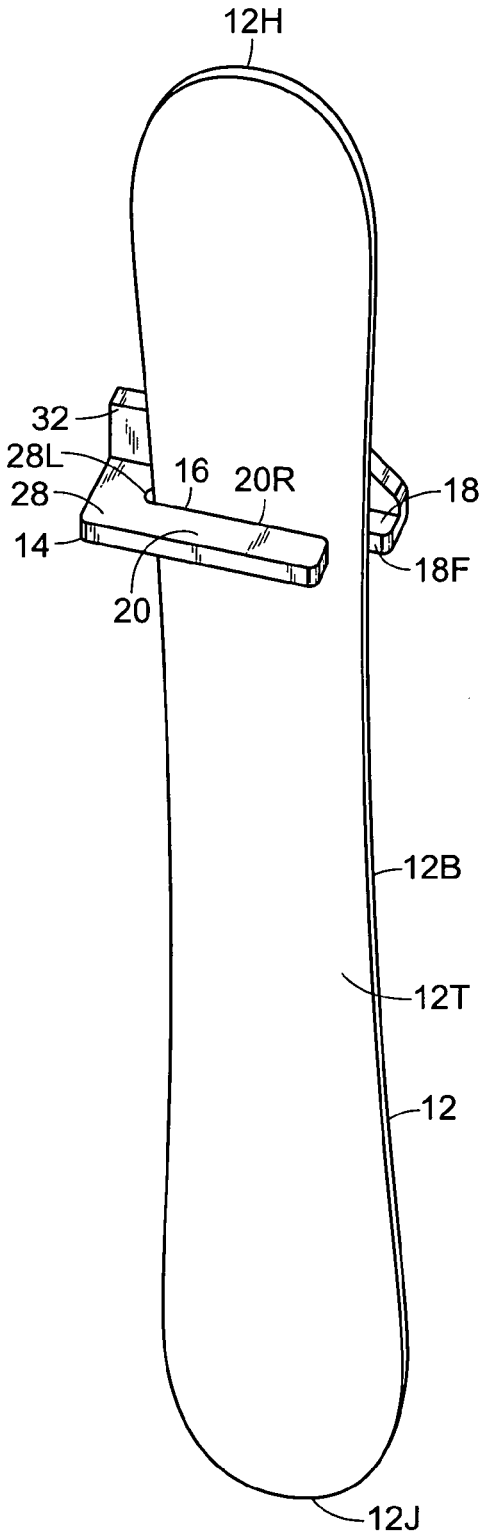
FIG. 7 is a perspective view of a third embodiment of the snowboard support and display rack, wherein the snowboard is vertically supported within the rack.

FIG. 7 illustrates the third embodiment of the snowboard support and display rack 10, wherein the snowboard 12 is supported in a vertical orientation within the rack 10. In this embodiment, there may be only one engagement member 14 for engagement and support of the snowboard 12. The structure of the engagement member 14 is substantially identical to the structure of the engagement members 14L and 14R of the first embodiment of the rack 10, as shown in FIG. 3 to FIG. 6. The engagement member 14 of the third embodiment also has a front prong 20, a rear prong 18, a junction 28 connecting the front prong 20 and the rear prong 18, and a base member 32 contiguous with and extending perpendicularly from the rear prong 18. The front prong 20 has a rear surface 20R. The rear prong 18 has a front surface 18F. The junction 28 has a curved surface 28L extending between the front prong 20 and the rear prong 18. Additionally, the engagement member 14 has a slot 16 defined by the rear surface 20R of the front prong 20, the curved surface 28L of the junction 28, and the front surface 18F of the rear prong 18. However, in this third embodiment, the slot 16 extends horizontally, unlike the vertically extending slots 16 of the first and the second embodiments.

To use the first embodiment of the rack 10, a user mounts the left engagement member 14L and the right engagement member 14R to a support structure with the prongs 18, 20 pointing vertically upward, by placing the rear surface 32R of the base member 32 flush against the support structure, by inserting a screw into each of the circular openings 24 within the engagement members 14L and 14R, and then by threading the screws into the support structure. The left engagement member 14L and the right engagement member 14R are mounted at the same height off the ground, and are separated from each other by a distance appropriate for the particularly sized snowboard 12 which is to be supported by the rack 10. For a longer snowboard 12, the distance between the left engagement member 14L and the right engagement member 14R will be larger, in order to support the board 12 along a substantial part of its length. The snowboard 12 is vertically lowered within the slots 16 of the left engagement member 14L and the right engagement member 14R and substantially supported upon the upper surface 28U of the junction 28 between the front prong 20 and the rear prong 18. To remove the snowboard 12 from the rack 10, the user simply lifts the snowboard vertically upward, and thereby disengages the snowboard 12 from the slots 16 of the rack 10. To use the second embodiment of the rack 10, the base member 22 is attached to the support structure at a suitable height above the ground by positioning the rack 10 flush against the support structure, by inserting a screw into each of the circular openings 24 in the base member 22, and by subsequently threading the screws into the support structure. The method by which the snowboard 12 is inserted into and removed from the rack 10 is identical to the method used for the first embodiment. The third embodiment of the rack 10 is also mounted to the support structure by insertion of screws into the circular openings extending through the base member 22, and by subsequently threading those screws into the support structure. However, the engagement member 14 of this embodiment is mounted with the prongs 18 and 20 extending laterally, thereby forming a horizontally situated slot 16, and the snowboard 12 is vertically lowered into the slot 16 and stored in a vertical orientation.

In conclusion, herein is presented a snowboard support and display rack. The invention is illustrated by example in the drawing figures, and throughout the written description. It should be understood that numerous variations are possible, while adhering to the inventive concept. Such variations are contemplated as being a part of the present invention.

What is claimed is:

1. A snowboard support and display rack for a snowboard having a top surface, a bottom surface, a toe, and a heel, comprising a pair of engagement members selectively attachable to a vertical support structure at the same height and at a position which is elevated with respect to the ground, each engagement member comprising a front prong, a rear prong, a junction connecting the front prong to the rear prong, and a base member extending from the rear prong at a right angle, said base member having a front surface and a rear surface, wherein the base member further includes two circular openings extending fully from the front surface to the rear surface, and wherein the engagement members are attached to the support structure by selectively inserting a screw into each of the circular openings, and by subsequently threading the screws into the support structure, wherein the junction has an upper surface, wherein the engagement members are attached to the support structure by selectively attaching the base members to the support structure, wherein said prongs extend vertically upward from the junction after the engagement members have been selectively attached to the support structure, wherein the front prong has a front surface and a rear surface, and wherein the rear prong has a front surface, and wherein each of the engagement members has a vertically oriented slot defined by the rear surface of the front prong, the upper surface of the junction, and the front surface of the rear prong, and wherein the snowboard is selectively lowered into the slots of the engagement members in order to display and support the snowboard upon the rack, and wherein the top surface and the bottom surface of the snowboard are bracketed by the slots of the engagement members when the snowboard is being supported upon the rack.

2. The snowboard support and display rack as recited in claim 1, wherein the rear surface of the front prong, and the front surface of the rear prong, are substantially lined with a protective insert comprising a strip of resilient material, for protecting the snowboard from becoming damaged upon selective insertion of the snowboard into the rack.

3. The snowboard support and display rack as recited in claim 2, wherein the front prong extends upwards a smaller distance than the rear prong, in order to facilitate insertion of the snowboard into the rack, and removal of the snowboard from the rack, when the rack is being deployed to selectively support the snowboard.

4. The snowboard support and display rack as recited in claim 3, wherein the pair of engagement members comprises a left engagement member and a right engagement member, said engagement members having a substantially identical structure, except that they differ in the direction in which the base member extends from the rear prong, said left engagement member having a structure which is a mirror image of the structure of the right engagement member.

5. The snowboard support and display rack as recited in claim 4, wherein the weight of the snowboard rests substantially upon the upper surface of the junctions between the front prongs and the rear prongs.

* * * * *